US009713384B1

(12) United States Patent
Chen

(10) Patent No.: US 9,713,384 B1
(45) Date of Patent: Jul. 25, 2017

(54) FRAME STRUCTURE OF NET CHAIR-BACK

(71) Applicant: Su-Ming Chen, Kaohsiung (TW)

(72) Inventor: Su-Ming Chen, Kaohsiung (TW)

( * ) Notice: Subject to any disclaimer, the term of this patent is extended or adjusted under 35 U.S.C. 154(b) by 0 days.

(21) Appl. No.: 15/152,574

(22) Filed: May 12, 2016

(51) Int. Cl.
*A47C 7/40* (2006.01)

(52) U.S. Cl.
CPC ..... *A47C 7/40* (2013.01)

(58) Field of Classification Search
CPC ..... A47C 7/40
USPC ..... 297/440.11, 440.2; 24/581.11; 411/508–509, 512
See application file for complete search history.

(56) References Cited

U.S. PATENT DOCUMENTS 4,810,144 A * 3/1989 Martelli ..... F16B 9/026 29/512 X
8,029,066 B2 * 10/2011 Su ..... A47C 7/40 297/440.11 X
2002/0195863 A1 * 12/2002 Su ..... A47C 7/282 297/440.11
2004/0262975 A1 * 12/2004 Su ..... A47C 5/06 297/440.11

* cited by examiner

*Primary Examiner* — Anthony D Barfield
(74) *Attorney, Agent, or Firm* — Leong C. Lei

(57) ABSTRACT

A net chair-back includes a first frame member, a second frame member corresponding to the first frame member and combined with the first frame member, and a net member arranged between the first frame member and the second frame member. The first frame member includes a recessed groove formed therein and arranged in a circumferentially surrounding form. The recessed groove includes a plurality of fixation posts mounted therein. The second frame member includes an insertion groove formed therein and arranged in a circumferentially surrounding form. The insertion groove includes a plurality of locking pillars formed therein. The locking pillars each include a retention member mounted thereto. The retention member is tightly engageable with an inside surface of the fixation post. In this way, exposing locking holes or threaded fasteners outside the net chair-back can be prevented to thereby improve the outside appearance of the net chair-back.

7 Claims, 7 Drawing Sheets

FRAME STRUCTURE OF NET CHAIR-BACK

(a) TECHNICAL FIELD OF THE INVENTION

The present invention relates generally to a frame structure of a net chair-back, and more particularly to a frame structure of a net chair-back that helps prevent deterioration of outside appearance of the net chair-back and also helps improve the outside appearance of the net chair-back.

(b) DESCRIPTION OF THE PRIOR ART

To allow a user to sit comfortably, a chair is often provided with a chair back. A number of chairs have chair backs embodied with net or similar articles to provide better ventilation and air permeability for the back of the user sitting on the chair. The net chair-back is now one of the main streams of the contemporary chairs.

As shown in FIGS. 1 and 2, a conventional net chair-back 1 comprises a first frame member 11, a second frame member 12 that corresponds to the first frame member 11, and a net member 2 fixed between the first frame member 11 and the second frame member 12.

As shown in FIG. 1, the first frame member 11 comprises a plurality of locking pillars 111 distributed alone a circumferential portion of the first frame member 11 and projecting toward the second frame member 12. The second frame member 12 comprises locking holes 121 formed therein to correspond to the locking pillars 111 of the first frame member 11. The net member 2 is attached to the first frame member 11 or the second frame member 12 as being pinned in position by mounting pins.

As shown in FIGS. 1 and 2, the second frame member 12 receives threaded fasteners S to extend through the locking holes 121 and screw to the locking pillars 111 of the first frame member 11 so as to combine the first frame member 11 and the second frame member 12 together and also to fix and cover a circumferential portion of the net member 2. In this way, the net chair-back 1 is assembled.

As shown in FIGS. 1 and 2, although the above-described structure allows the conventional net chair-back 1 to be assembled and securely fixed together, the locking holes 121 of the second frame member 12 are generally formed completely through the second frame member 12, so that when the net chair-back 1 is viewed from the rear side thereof, the locking holes 121 and the threaded fasteners S that are generally arranged in a circumferentially distributed manner are exposed and clearly observable on the rear of the net chair-back 1. This deteriorates the outside appearance of the net chair-back 1 and even cause degrading of the outside appearance of the entire chair, making it a poor product.

Thus, it is a challenge of the net chair-back manufacturers to provide a frame structure of a net chair-back that helps prevent deterioration of the outside appearance of the net chair-back

SUMMARY OF THE INVENTION

The primary object of the present invention is to provide a frame structure of a net chair-back, which helps alleviate the drawback that the conventional net chair-back allows locking holes and threaded fasteners exposed outside on the rear side of the chair.

Thus, according to the technical solution provided in claim 1, the present invention provides a frame structure of a net chair-back. The net chair-back comprises a first frame member, a second frame member corresponding to the first frame member and combined with the first frame member, and a net member arranged between the first frame member and the second frame member, wherein the first frame member comprises a recessed groove formed therein and arranged in a circumferentially surrounding form, the recessed groove comprising a plurality of fixation posts mounted therein; and the second frame member comprises an insertion groove formed therein and arranged in a circumferentially surrounding form, the insertion groove comprising a plurality of locking pillars formed therein. The locking pillars each comprise a retention member mounted thereto. The retention member is tightly engageable with an inside surface of the fixation post.

The efficacy that the technical solution of the present invention provided in claim 1 may achieve is that the insertion groove of the second frame member is provided with the retention members mounted thereto and the insertion groove receives the first frame member to insert therein, and the recessed groove of the first frame member is provided therein with the fixation posts, so that when the first frame member is inserted in to the second frame member, the retention members are respectively fit into and in mounting engagement with the fixation posts thereby securing fixing the first frame member in the second frame member. As such, the net chair-back so structured helps prevent locking holes or threaded fasteners from being exposed outside and the outside appearance of the net chair-back can be improved.

The foregoing objectives and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

BRIEF DESCRIPTION OF THE DRAWINGS

FIG. 4A is an enlarged view of a circled portion of FIG. 4, illustrating the retention member.

DETAILED DESCRIPTION OF THE PREFERRED EMBODIMENTS

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
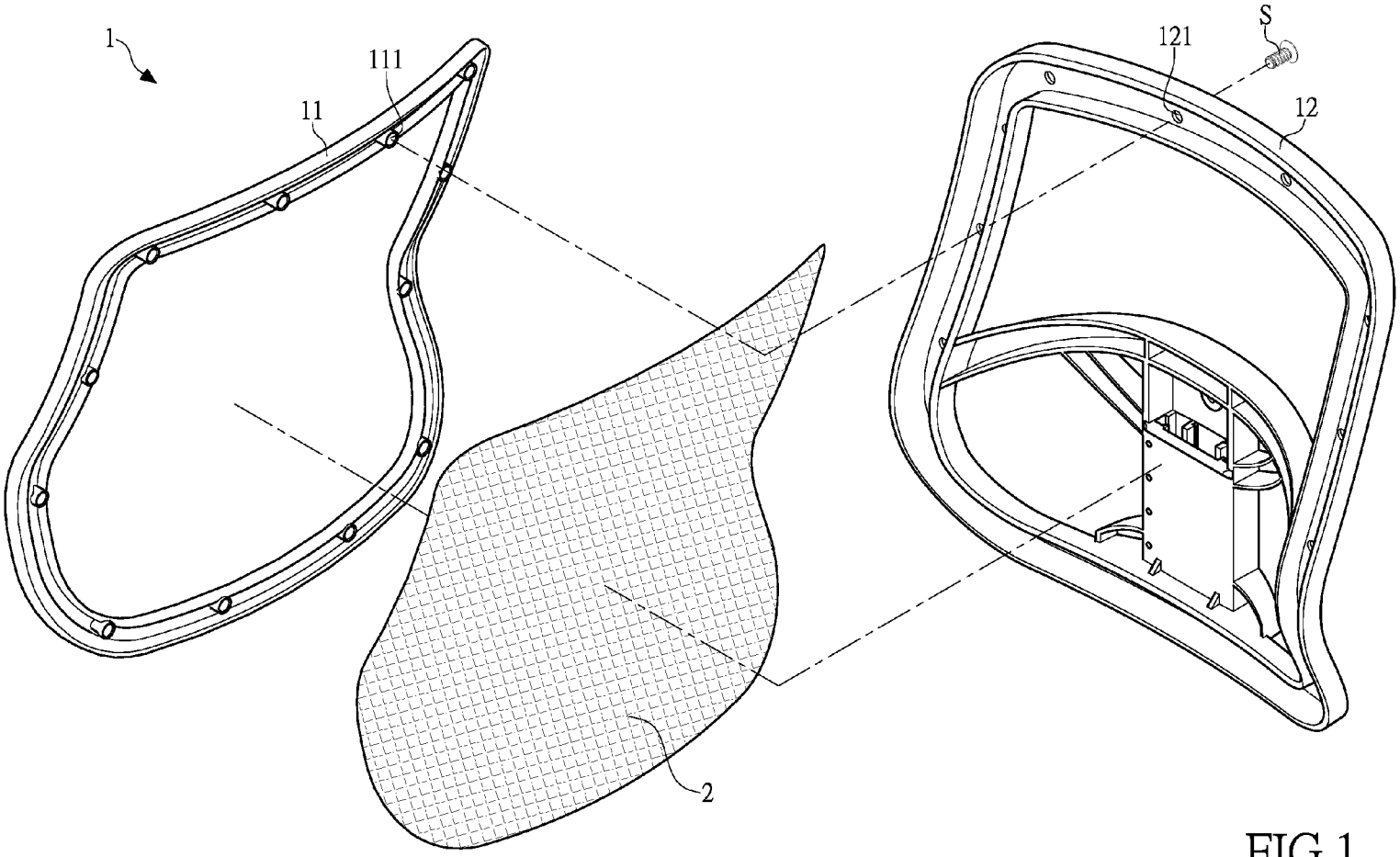
FIG. 1 is an exploded view of a conventional chair back.
Figure 2:
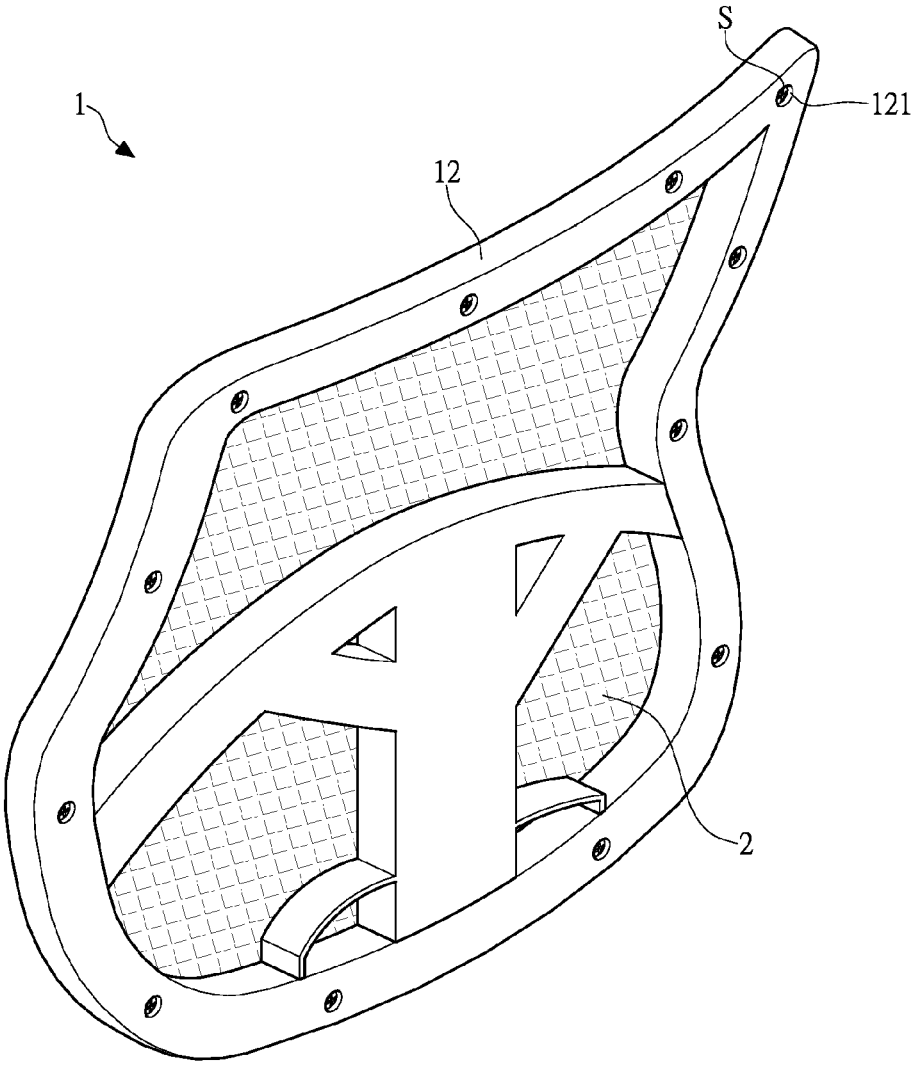
FIG. 2 is a perspective view of the conventional chair back in an assembled form.
Figures 3, 3A:
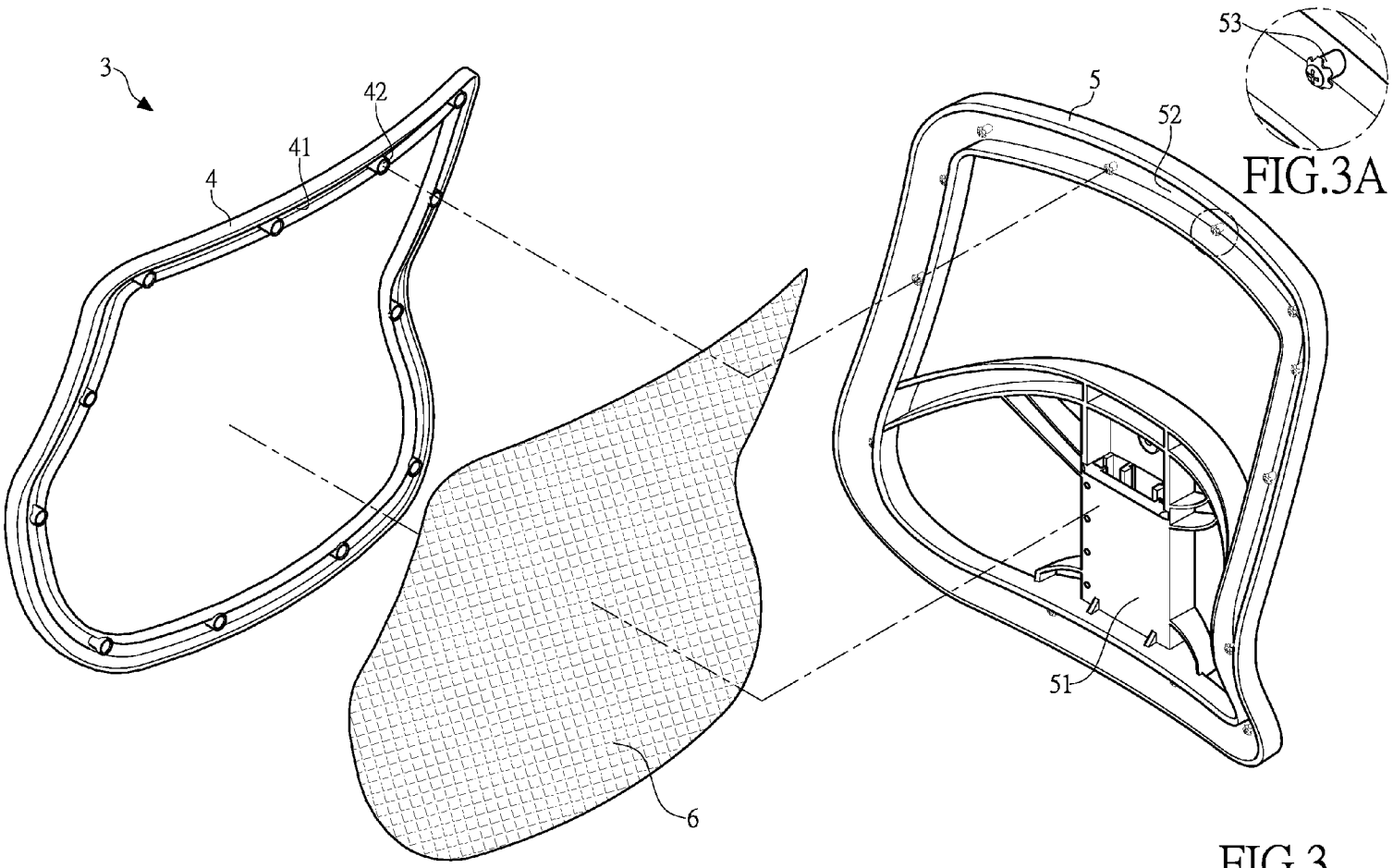
FIG. 3 is an exploded view showing a net chair-back constructed according to the present invention.
FIG. 3A is an enlarged view of a circled portion of FIG. 3.

Firstly, referring to FIG. 3, the present invention provides a frame structure of a net chair-back. A net chair-back 3 comprises a first frame member 4, a second frame member 5 corresponding to the first frame member 4 and combinable with the first frame member 4, and a net member 6 arranged between the first frame member 4 and the second frame member 5.

As shown in FIG. 3, the first frame member 4 is made in the form of a surrounding frame having a hollowed central portion and a circumferential portion surrounding the hollowed central portion. The circumferential portion of the first frame member 4 is provided with a recessed groove 41 circumferentially extending along the circumferential portion. The recessed groove 41 comprises a plurality of fixation posts 42 mounted therein. The fixation posts 42 are distributed, in the circumferential direction, along the recessed groove 41 of the first frame member 4 and spaced from each other. The fixation posts 41 are each a projecting post having an end in which a blind hole is formed.

Figure 4:
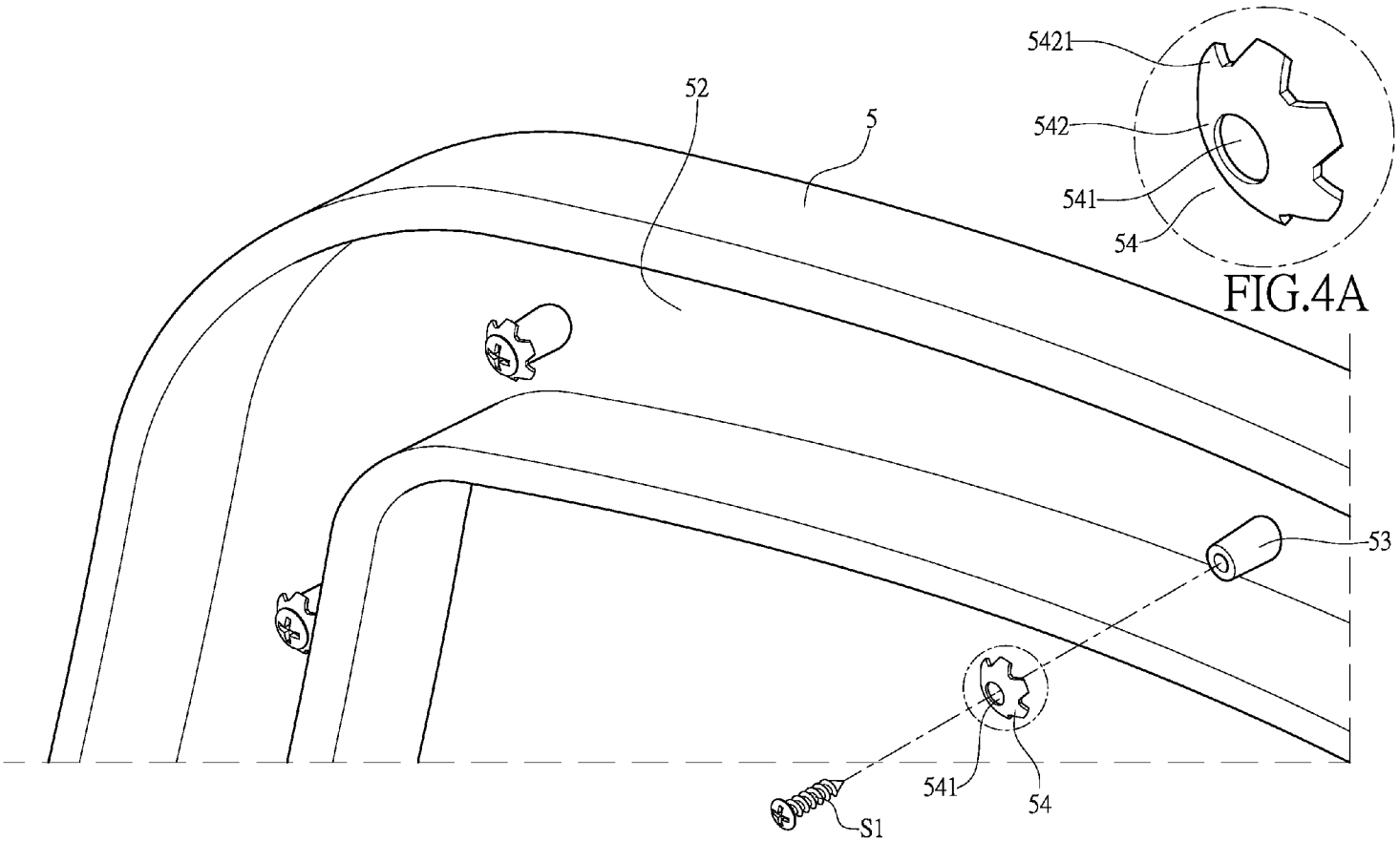
FIG. 4 is an enlarged view of a portion of the net chair-back of the present invention for illustrating a retention member.
Figure 5:
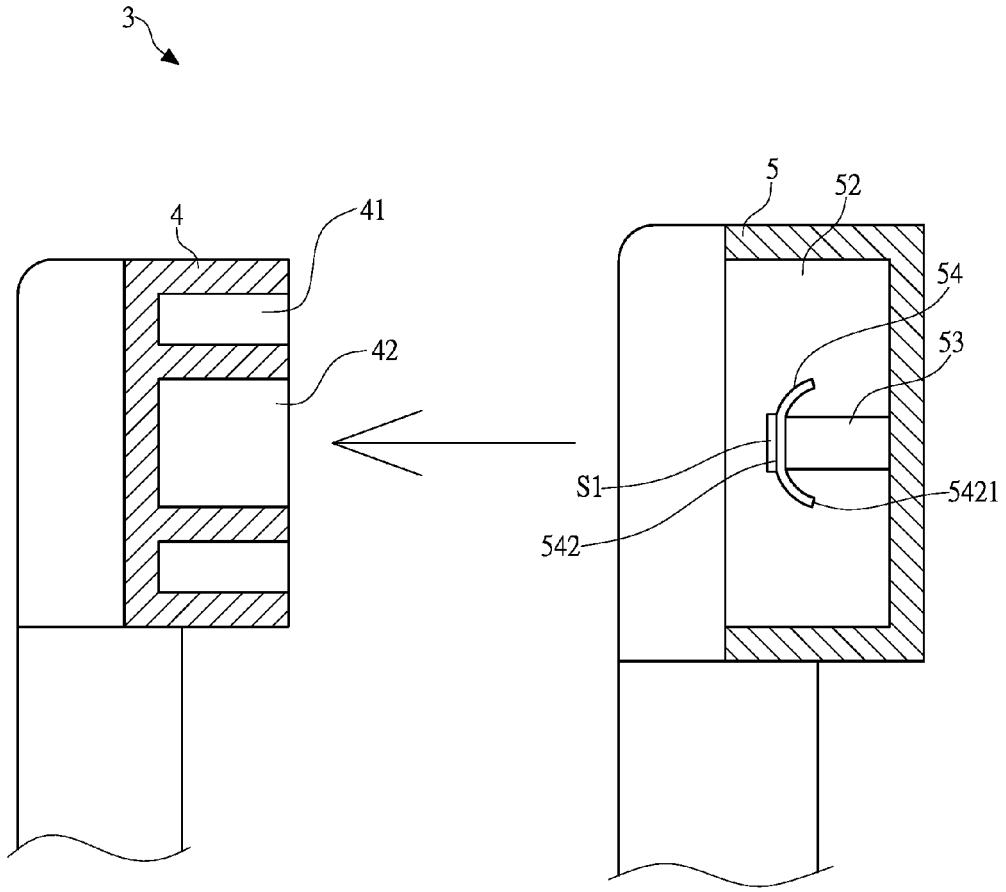
FIGS. 5 and 6 are cross-sectional views illustrate assembly of the net chair-back according to the present invention.
Figure 6:
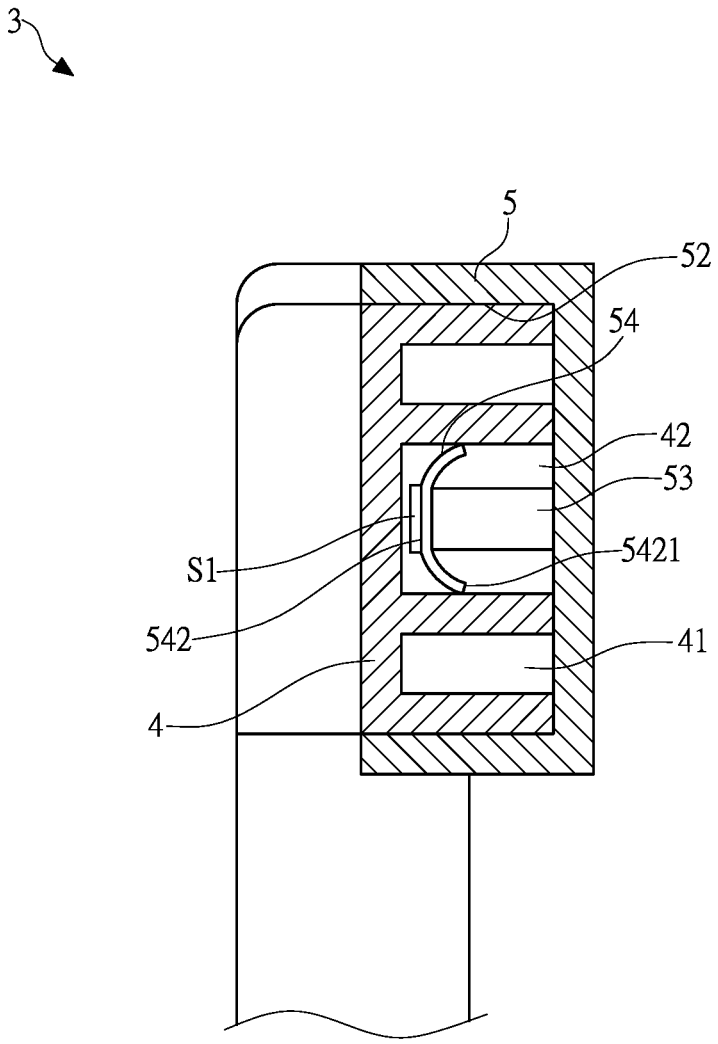
Figure 7:
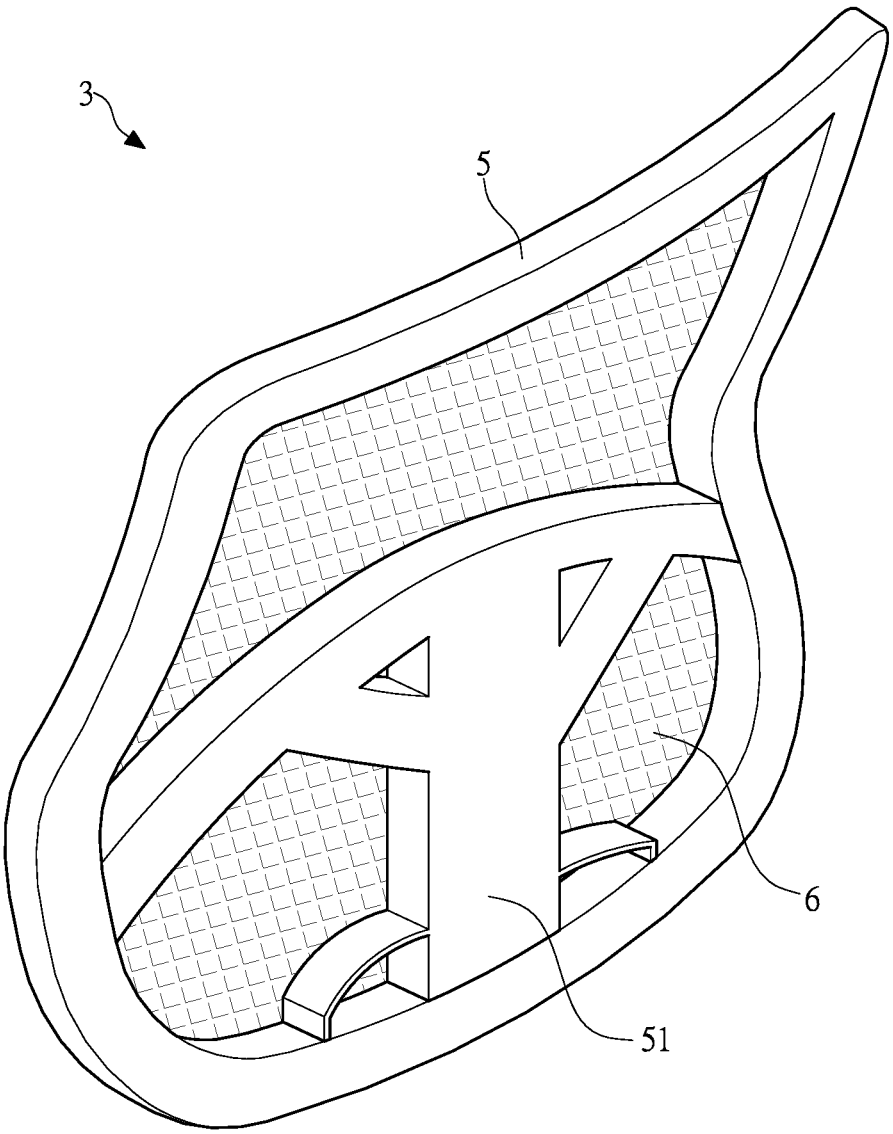
FIG. 7 is a perspective view showing the net chair-back of the present invention in an assembled form.

As shown in FIGS. 3 and 4, the second frame member 5 is made in the form of a surrounding frame having a hollowed central portion and a circumferential portion surrounding the hollowed central portion. The second frame member 5 is provided with a support section 51 in a lower part of the central portion. The circumferential portion of the second frame member 5 is recessed to form a circumferentially extending insertion groove 52 such that the insertion groove 52 of the second frame member 5 corresponds to the circumferential portion of the first frame member 4 to allow the circumferential portion of the first frame member 4 to be inserted into the insertion groove 52 of the second frame member 5. The insertion groove 52 comprises locking pillars 53 mounted therein. The locking pillars 53 are distributed, in the circumferential direction, along the insertion groove 52 and spaced from each other such that the locking pillars 53 respectively correspond to the fixation posts 42 of the first frame member 4. The locking pillars 53 each receive a retention member 54 mounted thereto by a threaded fastener 51. The retention member 54 is made of a metallic material having predetermined stiffness. The retention member 54 has a central portion in which a through hole 541 is formed. The through hole 541 receives the threaded fastener S1 to extend therethrough. The retention member 54 is made to expand outwards in a curved form to form a retention section 542 and the retention section 542 has an outer circumferential edge that is split to form a plurality of retention tabs 5421 circumferentially spaced from each other.

As shown in FIG. 3, the net member 6 is attached the first frame member 4 or the second frame member 5 by being pinned in position by mounting pins (not shown in the drawings).

As shown in FIGS. 3, 4, 5, 6, and 7, the net chair-back 3 of the present invention is embodied such that the retention members 54 are first mounted by the threaded fasteners S1 to the locking pillars 53 of the second frame member 5. The net member 6 is pinned and thus attached to the first frame member 4 or the second frame member 5. The circumferential portion of the first frame member 4 is inserted into the insertion groove 52 of the second frame member 5 such that the blind holes of the fixation posts 42 of the first frame member 4 are respectively fit over and thus coupled to the retention members 54 with the retention tabs 5421 of the retention member 54 being in tight engagement, preferably through slight deformation, with and thus fixed to an inside surface of the blind hole of the fixation posts 42. As such, the circumferential portion of the first frame member 4 is securely fixed in the insertion groove 52 of the second frame member 5 and thus, assembly of the net chair-back 3 according to the present invention is completed.

The efficacy of the present invention is that the insertion groove 52 of the second frame member 5 is provided with the retention members 54 mounted thereto and the insertion groove 52 receives the first frame member 4 to insert therein, and the recessed groove 41 of the first frame member 4 is provided therein with the fixation posts 42, so that when the first frame member 4 is inserted in to the second frame member 5, the retention members 54 are respectively fit into and in mounting engagement with the fixation posts 42 thereby securing fixing the first frame member 4 in the second frame member 5. As such, the net chair-back 3 so structured helps prevent locking holes or threaded fasteners S1 from being exposed outside and the outside appearance of the net chair-back 3 can be improved.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the claims of the present invention.

I claim:

1. A frame structure of a net chair-back, the net chair-back comprising a first frame member, a second frame member corresponding to the first frame member and combined with the first frame member, and a net member arranged between the first frame member and the second frame member, wherein the first frame member comprises a recessed groove formed therein and arranged in a circumferentially surrounding form, the recessed groove comprising a plurality of fixation posts mounted therein; and the second frame member comprises an insertion groove formed therein and arranged in a circumferentially surrounding form, the insertion groove comprising a plurality of locking pillars formed therein and respectively corresponding to the fixation posts, the locking pillars each comprising a distal end facing the corresponding one of the fixation posts and having a retention member mounted thereto such that the retention member is receivable between the distal end of the locking pillar and the corresponding one of the fixation posts, the retention member being tightly engageable with an inside surface of the fixation post;

wherein the retention members are mounted to the distal ends of the locking pillars with threaded fasteners such that the retention members and the fasteners are received and concealed between the locking pillars and the fixation posts.

2. The frame structure of the net chair-back according to claim 1, wherein the fixation posts are circumferentially distributed along the recessed groove and spaced from each other.

3. The frame structure of the net chair-back according to claim 2, wherein the fixation posts each comprise a blind hole formed therein.

4. The frame structure of the net chair-back according to claim 1, wherein the locking pillars are circumferentially distributed along the insertion groove and are spaced from each other.

5. The frame structure of the net chair-back according to claim 1, wherein the retention members each have a central portion in which a through hole is formed.

6. The frame structure of the net chair-back according to claim 5, wherein the retention members each comprise a retention section expanding outwards from the through hole in a curved form.

7. The frame structure of the net chair-back according to claim 1, wherein the retention section has a circumferential edge that is split to form a plurality of retention tabs.

* * * * *